US006105835A

United States Patent [19]

Hatakeyama

[11] Patent Number: 6,105,835

[45] Date of Patent: Aug. 22, 2000

[54] HANGER

[75] Inventor: Shu Hatakeyama, Tokyo, Japan

[73] Assignee: Poppy Pack Co., Ltd., Tokyo, Japan

[21] Appl. No.: 09/306,791

[22] Filed: May 7, 1999

[30] Foreign Application Priority Data

May 8, 1998 [JP] Japan ..... 10-142166

[51] Int. Cl.[7] ..... A47G 25/18

[52] U.S. Cl. ..... 223/88; 223/91

[58] Field of Search ..... 223/85, 88, DIG. 1, 223/DIG. 2, DIG. 3, DIG. 4, 96, 91

[56] References Cited

U.S. PATENT DOCUMENTS

| | | | |
|---|---|---|---|
| 1,462,067 | 7/1923 | McKenna | 223/88 |
| 2,391,661 | 12/1945 | Watkins et al. | 223/88 |
| 2,634,031 | 4/1953 | Klein | 223/DIG. 1 |
| 2,994,462 | 8/1961 | Hirsch et al. | 223/DIG. 1 |
| 5,062,556 | 11/1991 | Willputz | 223/96 |
| 5,074,445 | 12/1991 | Hen | 223/88 |
| 5,074,447 | 12/1991 | Koton et al. | 223/DIG. 1 |
| 5,509,587 | 4/1996 | Gouldson et al. | 223/96 |
| 5,603,438 | 2/1997 | Jugan | 223/88 |

*Primary Examiner*—Bibhu Mohanty
*Attorney, Agent, or Firm*—Lowe Hauptman Gopstein Gilman & Berner

[57] ABSTRACT

A hanger for clothes to be displayed as goods. The hanger comprises a hanger main body including an upper laterally extending member, and a hook to be hanged, connected to the upper laterally extending member. A connecting section integral with the upper laterally extending member of the hanger main body. Additionally, a hanger auxiliary body is integral with the connecting section. The hanger auxiliary body includes a lower laterally extending member which is generally parallel with the upper laterally extending member, and first and second support members for supporting a lower part of the clothes. The first and second, support members are connected respectively with opposite ends of the lower laterally extending member so as to form a generally U-shaped bent portion between each of the opposite ends and each of the first and second support members. Each of the first and second support members extends generally parallel with the lower laterally extending member. At least the upper laterally extending member of the hanger main body, the connecting section, and the hanger auxiliary body are formed integral to constitute a one-piece structure, and formed of plastic.

11 Claims, 4 Drawing Sheets

HANGER

BACKGROUND OF THE INVENTION

1. Field of the Invention

This invention relates to improvements in a hanger, and more particularly to a hanger for clothes, which makes it possible to display the clothes without being wrapped and to make the clothes prominent thereby improving an effect of sales promotion.

2. Description of the Prior Art

Hitherto clothes such as a T-shirt and a polo shirt, and the like are usually folded and wrapped with a transparent wrapping sheet to form a wrapped package, or hanged on a hanger in order to be displayed as goods. Difficulties have been encountered in such display manners for the clothes. That is, concerning the display manner in which the clothes are folded and wrapped with the transparent wrapping sheet to form the wrapped package, the whole body of the clothes or goods cannot be seen because the goods are folded, and additionally it is difficult to restore the goods into their original state after the goods are taken out from the wrapped package in order to see the whole body of the goods. In case that the goods are an underwear or the like, there is the fear of the underwear or the like becoming dirty, and therefore it is impossible to take out the goods from the wrapping package and develop the goods. Concerning the display manner in which the goods are hanged on the hanger, not only a considerable space is required to develop and hang the goods on the hanger, but also the goods cannot be well seen if the hangers with the goods are tightly put side by side, thereby diminishing an effect of sales promotion.

BRIEF SUMMARY OF THE INVENTION

It is an object of the present invent to provide an improved hanger for goods, which can effectively overcome drawbacks encountered in conventional hangers for goods.

Another object of the present invention is to provide an improved hanger for goods, which can make the goods prominent when used thereby improving an effect of sales promotion, while making it possible that customers can confirm the features of the goods at the first glance. Besides, the hanger can provide a high space-utilizing efficiency and a high laborsaving for displaying the goods, while efficiently exhibiting the inherent function of the hanger.

A further object of the present invention is to provide an improved hanger for clothes, by which the clothes can be displayed upon being directly hanged on the hanger so as to make it unnecessary to carry out troublesome operations such as taking out the goods from the wrapped package and wrapping again the goods which have been taken out and developed.

An aspect of the present invention resides in a hanger for goods, comprising a hanger main body having a hook to be hanged, the hanger main body supporting an upper section of the goods. A connecting section is connected to the hanger main body. Additionally, a hanger auxiliary body is connected through the connecting section with the hanger main body. The hanger auxiliary body has a support section for supporting a lower part of the goods.

Another aspect of the present invention resides in a hanger for clothes, comprising a hanger main body having a hook to be hanged, the hanger main body supporting an upper section of the clothes. A connecting section is connected to the hanger main body. Additionally, a hanger auxiliary body is connected through the connecting section with the hanger main body. The hanger auxiliary body has a support section for supporting a lower part of the clothes.

A further aspect of the present invention resides in a hanger for clothes, comprising a hanger main body including an upper laterally extending member, and a hook to be hanged, connected to the upper laterally extending member. A connecting section integral with the upper laterally extending member of the hanger main body. Additionally, a hanger auxiliary body is integral with the connecting section. The hanger auxiliary body includes a lower laterally extending member which is generally parallel with the upper laterally extending member, and first and second support members for supporting a lower part of the clothes. The first and second support members are connected respectively with opposite ends of the lower laterally extending member so as to form a generally U-shaped bent portion between each of the opposite ends and each of the first and second support members. Each of the first and second support members extends generally parallel with the lower laterally extending member. At least the upper laterally extending member of the hanger main body, the connecting section, and the hanger auxiliary body are formed integral to constitute a one-piece structure, and formed of plastic.

BRIEF DESCRIPTION OF THE DRAWINGS

In the drawings, like reference numerals designate like parts and elements throughout all figures, in which.

DETAILED DESCRIPTION OF THE INVENTION

Figure 1:
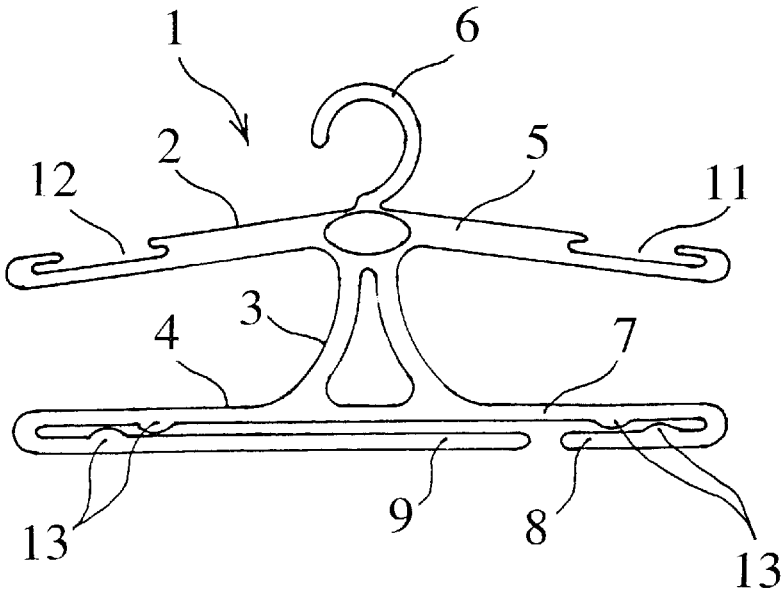
FIG. 1 is a front view of an embodiment of a hanger according to the present invention.

Referring now to FIG. 1, an embodiment of a hanger according to the present invention is illustrated by the reference numeral 1. The hanger 1 of this embodiment comprises a hanger main body 2, and a hanger auxiliary body 4. The hanger auxiliary body 4 is securely connected through a connecting section 3 to the hanger main body 2. The hanger 1 is formed of plastic, metal, composite material, or the like. In this embodiment, at least the hanger main body 2, the connecting section 3 and the hanger auxiliary body 4 are formed integral to constitute a one-piece structure.

As clearly shown in FIG. 1, the hanger main body 1 includes an upper laterally extending member 5 which generally laterally extends. The upper laterally extending member 5 is formed arcuate to protrude upwardly and to extend along a large-diameter circle (not shown). The upper laterally extending member 5 is formed with a left-side cutout 11 and a light-side cutout 12 which are located respectively at the left-side end section and the right-side end section of the upper laterally extending member 5. Each cutout 11, 12 is opened to the upper edge of the upper laterally extending member 5 and formed such that its upper portion (not identified) opened to the upper edge of the upper laterally extending member 5 is smaller in lateral length than its lower portion (not identified) merged in the upper portion. A hook 6 to be hung up is connected to an upper and central portion of the upper laterally extending member 5.

The hanger auxiliary body 4 includes a lower laterally extending member 7 which laterally and generally straight extends to be generally parallel with the upper laterally extending member 5. The lower laterally extending member 7 includes a left-side support member 8, and a right-side support member 9 which are formed connected and parallel with the lower laterally extending member 7 in a manner to be spaced from the lower laterally extending member 7. The support members 8, 9 are located below the lower laterally extending member 7 and serve to support a lower part of a fabric article or goods, for example, clothes such as a T-shirt or a polo shirt. The lower laterally extending member 7 is connected at its left-side end with the left-side support member 8 to form a left-side U-shaped bent portion (not identified) and connected at its right-side end with the right-side support member 9 to form a right-side U-shaped bent portion (not identified). The left-side support member 8 is formed shorter so as not to extend rightward over the lengthwise central portion of the lower laterally extending member 7, while the right-side support member 9 is formed longer so as to extend leftward over the lengthwise central portion of the lower laterally extending member 7.

A plurality of engagement projections 13, 13 are formed at the lower or inner edge of the lower laterally extending member 7 and located respectively in the vicinity of the left-side and right-side U-shaped bent portions. Each engagement projection 13 projects toward the upper or inner edge of the left-side or right-side support member 8, 9. Another engagement projection 13 is formed at the upper or inner edge of the left-side support member 8 and located in the vicinity of the left-side U-shaped bent portion, in which the engagement projection 13 projects toward the lower edge of the lower laterally extending member 7. A further engagement projection 13 is formed at the upper or inner edge of the right-side support member 9 and located in the vicinity of the right-side U-shaped bent portion, in which the engagement projection 13 projects toward the lower edge of the lower laterally extending member 7. Each engagement projection 13 is formed projecting in the shape of a semicircle on an imaginary plate parallel with the lower laterally extending member 7, and slightly spaced from the opposed or inner edge of the lower laterally extending member 7 or of the support member 8, 9. The two engagement projections 13, 13 located near and projected respectively from the lower laterally extending member 7 are positioned slightly separate from each other in a lateral direction or longitudinal direction of the lower laterally extending member 7. It will be understood that the above-mentioned cutouts 11, 12 function to support another part the fabric article or goods, for example, the clothes such as the T-shirt or the polo shirt.

Although two engagement projections and two engagement projections (totally four engagement projections) have been shown and described as being formed respectively at the sides of the lower laterally extending member 7 and the support members 8, 9, it will be understood that the number of the engagement projections to be formed may be increased.

Figure 2:
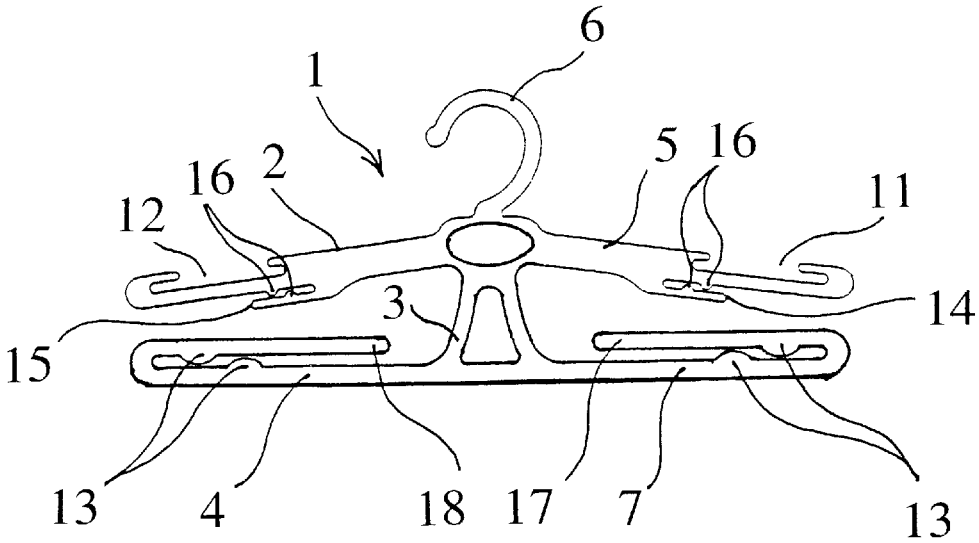
FIG. 2 is a front view of another embodiment of the hanger according to the present invention.

FIG. 2 illustrates another embodiment of the hanger according to the present invention, similar to the embodiment of FIG. 1. In this embodiment, the hanger auxiliary body 4 includes the lower laterally extending member 7 which laterally and generally straight extends and generally parallel with the upper laterally extending member 5. The lower laterally extending member 7 includes a left-side support member 17, and a right-side support member 18 which are formed connected with and parallel with the lower laterally extending member 7 in a manner to be spaced from the lower laterally extending member 7. The support members 17, 18 are located above the lower laterally extending member 7 and serve to support a lower part of a fabric article or goods, for example, clothes such as a T-shirt or a polo shirt. The lower laterally extending member 7 is connected at its left-side end with the left-side support member 17 to form a left-side U-shaped bent portion (not identified) and connected at its right-side end with the right-side support member 18 to form a right-side U-shaped bend portion (not identified). The left-side support member 17 and the right-side support member 18 are formed generally the same in lateral length, in which each support member 17, 18 extends toward the connecting section 3 or lengthwise central portion of the lower laterally extending member 7 so as to have a free end which is located near and spaced from the connecting section 3.

A plurality of engagement projections 13, 13 are formed at the upper edge of the lower laterally extending member 7 and located respectively in the vicinity of the left-side and right-side U-shaped bent portions. Each engagement projection 13 projects toward the lower or inner edge of the left-side or right-side support member 17, 18. Another engagement projection 13 is formed at the lower or inner edge of the left-side support member 17 and located in the vicinity of the left-side U-shaped bent portion, in which the engagement projection 13 projects toward the upper or inner edge of the lower laterally extending member 7. A further engagement projection 13 is formed at the lower edge of the right-side support member 18 and located in the vicinity of the right-side U-shaped bent portion, in which the engagement projection 13 projects toward the upper or inner edge of the lower laterally extending member 7. Each engagement projection 13 is formed projecting in the shape of a semicircle on an imaginary vertical plane parallel with the lower laterally extending member 7, and slightly spaced from the opposed or inner edge of the lower laterally extending member 7 or of the support member 8, 9. The two engagement projections 13, 13 located near and projected respectively from the lower laterally extending member 7 are positioned slightly separate from each other in a lateral direction or longitudinal direction of the lower laterally extending member 7.

Although two engagement projections and two engagement projections (totally four engagement projections) have been shown and described as being formed respectively at the sides of the lower laterally extending member 7 and the support members 8, 9, it will be understood that the number of the engagement projections to be formed may be increased.

In this embodiment, auxiliary small left-side and right-side support members 14, 15 are respectively formed extending from the lower edge of the left-side section and the lower edge of the right-side section of the upper laterally extending member 5 of the upper hanger body 5. Each support member 14, 15 extends parallel with the upper laterally extending member 5 and toward the end of the right-side or left-side section of the upper laterally extending member 5. Two small projections 16 which are similar respectively to the projections 13, 13 are formed projecting respectively from the lower or inner edge of the hanger main body 2 and the upper or inner edge of the left-side or right-side support member 14, 15. The two small projections 16, 16 are arranged similarly to the above-discussed projections 13, 13. It will be understood that the auxiliary small left-side and right-side support members 14, 15 function to support another parts of the fabric article or goods, for example, the clothes such as the T-shirt or the polo shirt.

A manner of use of the hanger 1 of the embodiment of FIG. 2 will be discussed with reference to FIGS. 3 to 8.

Figure 3:
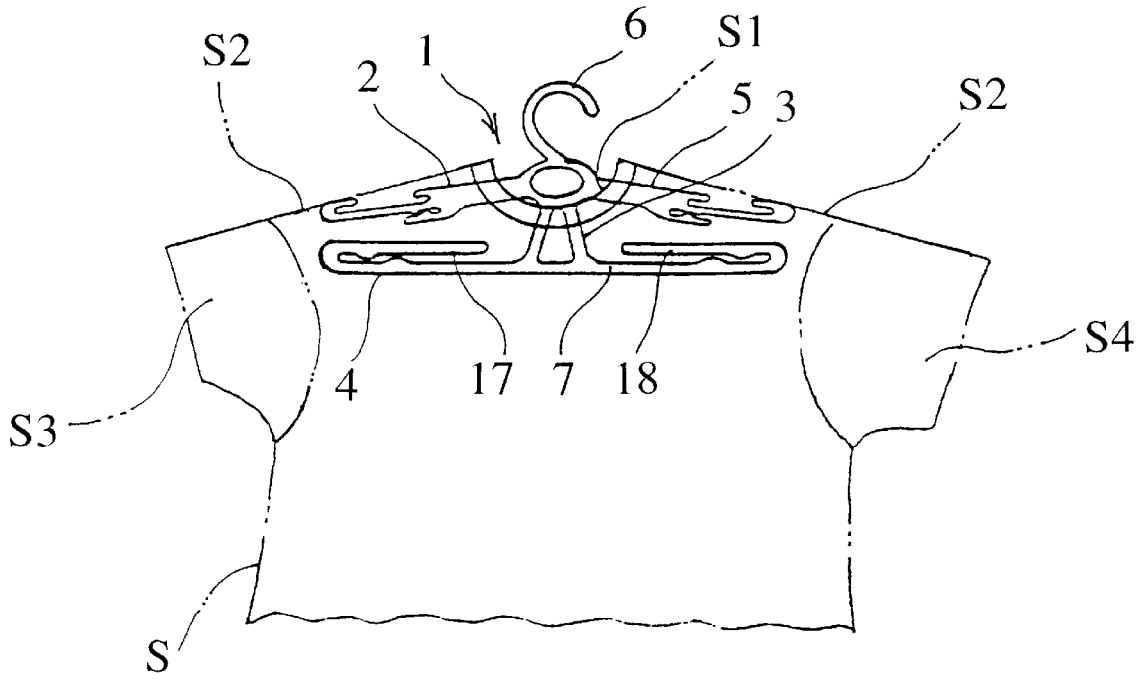
FIG. 3 is a rear view of the hanger of FIG. 2, showing a first using state in which a shirt is supported by an upper laterally extending member of the hanger.

First, as shown in FIG. 3, the upper laterally extending member 5 of the hanger main body 2 is inserted inside the shirt (T-shirt or polo shirt) S through the neck line S1 of the Shirt S in such a manner that the hook 6 of the upper hanger body 2, the connecting section 3 and the hanger auxiliary body 4 are located outside the shirt S. In FIG. 3, the back surface of the back section and the sleeve sections of the shirt S are shown. Thus, the left-side and right-side shoulder sections S2, S2 of the shirt S are supported by the upper laterally extending member 5, while the back surfaces of the left-side and right-side shoulder sections S2 are pressed by the hanger auxiliary body 4.

Figure 4:
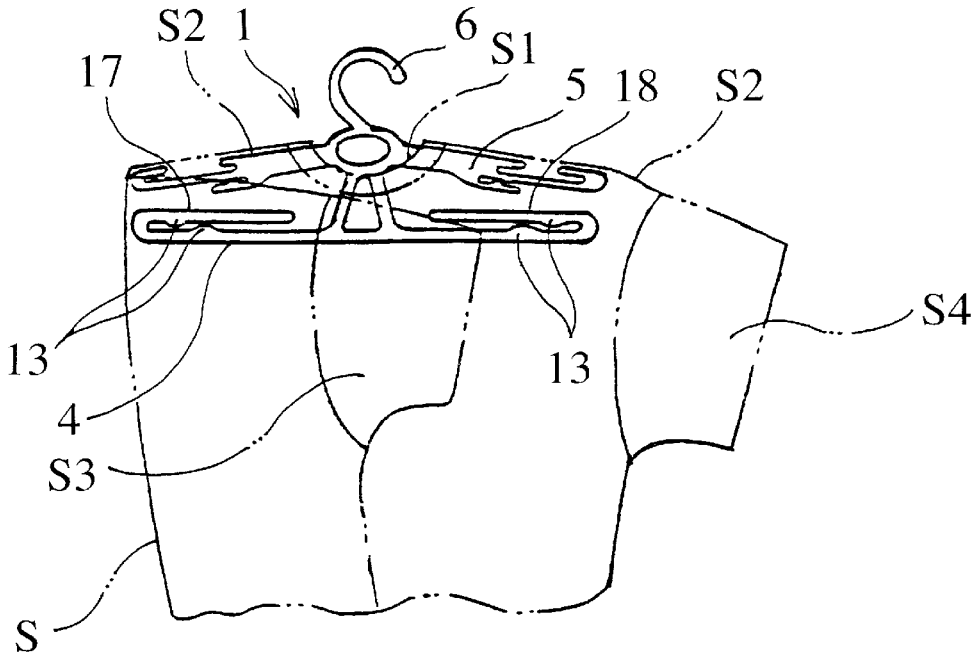
FIG. 4 is a rear view of the hanger of FIG. 2, showing a second using state in which a sleeve of the shirt is folded back and supported under a hanger auxiliary body of the hanger.

Subsequently, as shown in FIG. 4, the left-side sleeve S3 is folded back on the back surface of the left-side and right-side shoulder sections S2 of the shirt S and located between the back surface of the right-side shoulder section S2 and the auxiliary hanger body 4, so that the left-side sleeve S3 is tightly supported between the upper laterally extending member 5 of the hanger main body 2 and the hanger auxiliary body 4.

Figure 5:
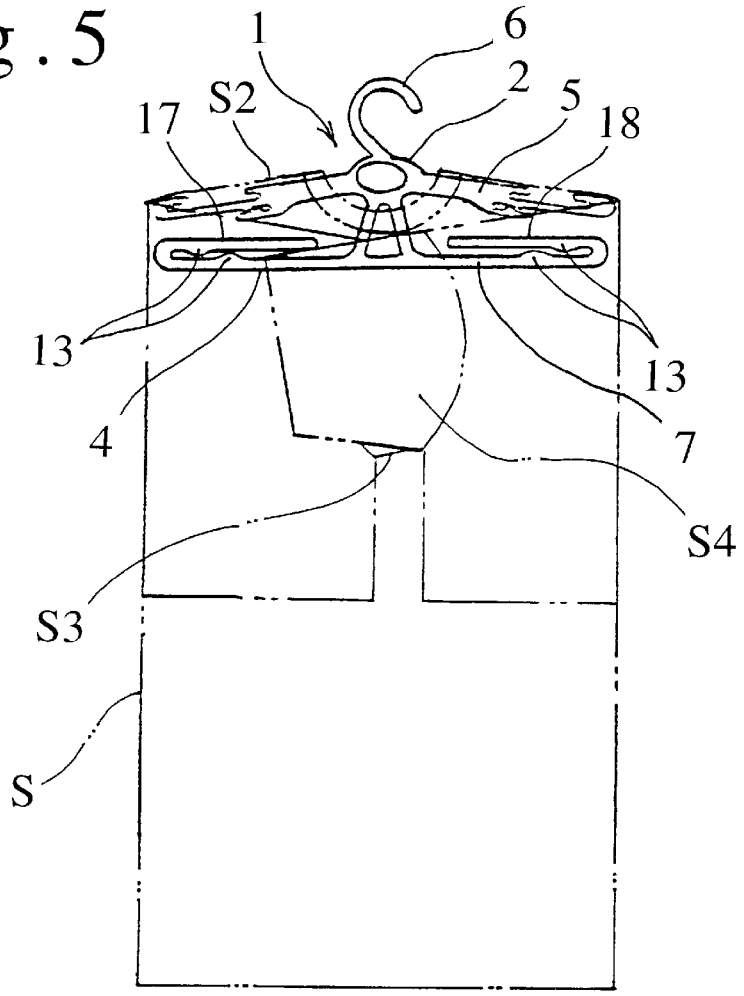
FIG. 5 is a rear view of the hanger of FIG. 2, showing a third using state in which another sleeve is folded back and supported under the hanger auxiliary body of the hanger.

Thereafter, as shown in FIG. 5, the right-side sleeve S4 is folded back on the back surface of the left-side and right-side shoulder section S2 in the similar manner to that for the left-side sleeve S3 and put on the left-side sleeve S3, so that the right-side sleeve S4 is tightly supported between the upper laterally extending member 5 of the hanger main body 2 and the hanger auxiliary body 4.

Figure 6:
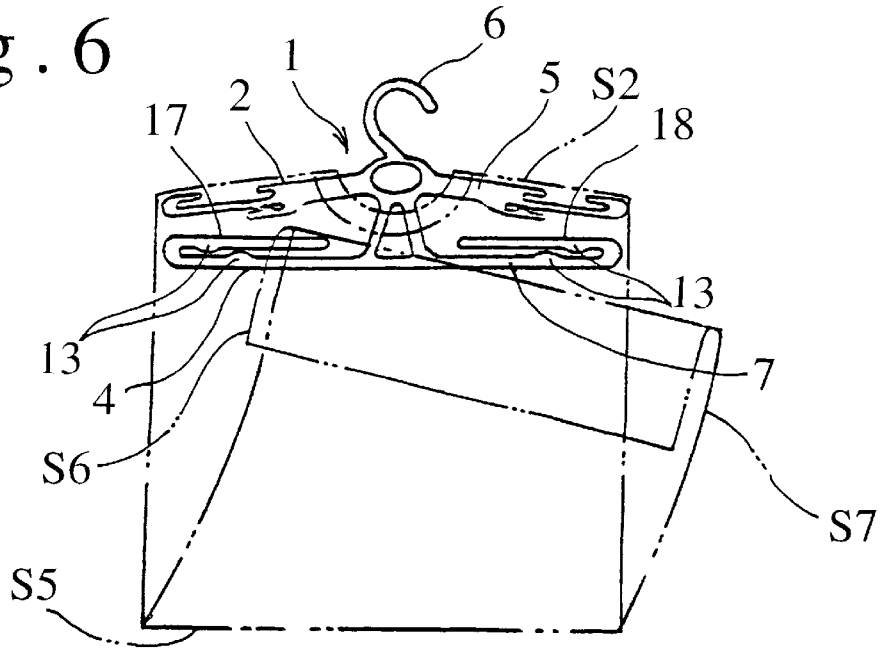
FIG. 6 is a rear view of the hanger of FIG. 2, showing a fourth using state in which the shirt is folded back at its linear middle portion, and a side portion of a sleeve section of the shirt is supported by a support member.

Next, as shown in FIG. 6, the lower part of the shirt S is folded back at a linear middle portion S5 which is located at a position of about ½ of the whole length of the shirt S, and put on the back surface of the back section of the shirt S. The skirt section of the shirt S (forming part of the folded-back lower part) is further folded inside at a linear skirt portion which is located at a position of about ¼ of the whole length of the shirt S, and put on the folded-back lower part of the shirt S. One of left and right side portions S6, S7 of the folded-back skirt section of the shirt S is inserted into between the one of the support members 17, 18 and the lower lately extending member 7. In this instance, the left side portion S6 of the folded-back skirt section of the shirt S is inserted into between the right-side support member 17 and the lower laterally extending member 4 to be securely supported.

Figure 7:
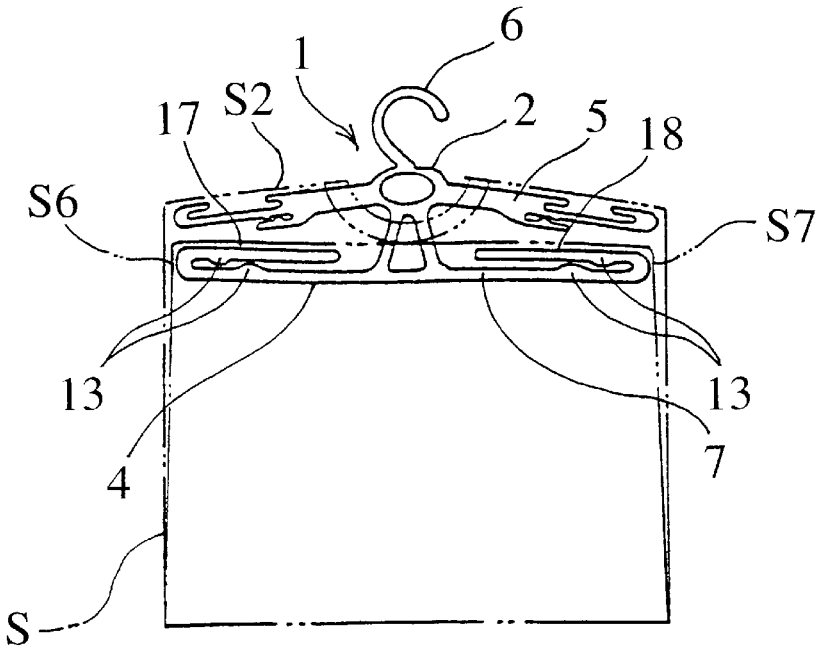
FIG. 7 is a rear view of the hanger of FIG. 2, showing a fifth using state in which another side portion of the sleeve section of the shirt is supported by another support member.

Then, as shown in FIG. 7, another of left and right side portions S6, S7 of the folded-back skirt section of the shirt S is inserted into between one of the support members 17, 18 and the lower laterally extending member 7. In this instance, the right side portion S7 of the folded-back skirt section of the shirt S is inserted into between the left-side support member 18 and the lower laterally extending member 4 to be securely supported.

Figure 8:
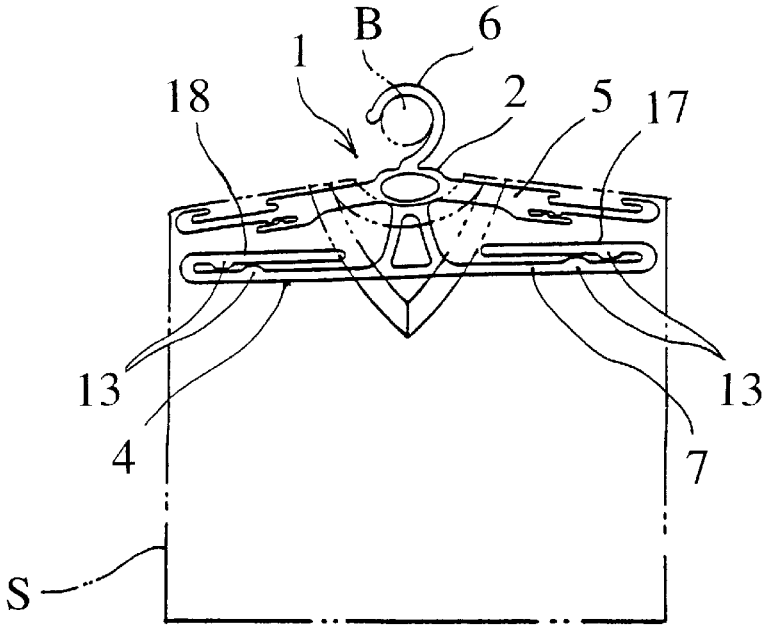
FIG. 8 is a front view of the hanger of FIG. 2, showing a sixth using state in which the shirt is turned over so that the front surface of the shirt is seen, and a hook of the hanger is hanged on a supporting rod of a display stand.

Thus, the shirt S is brought into a state in which both the left-side and right-side shoulder sections S2 are securely supported by the upper laterally extending member 5, while the left and right side portions S6, S7 of the folded-back skirt section of the shirt S are inserted into between the lower laterally extending member 7 and the support members 17, 18. In this state, as shown in FIG. 8, the shirt S is turned over in such a manner that the front surface of the shirt S is located at the front side as illustrated in FIG. 8, so that the back surface of the shirt S is located at the back side. Then, the hook 6 to be hanged is hanged on a support rod B or the like of a display stand, thereby accomplishing display of the shirt S. As a result, the shirt S such as the T-shirt or the polo shirt can be displayed as goods without being wrapped.

Thus, by using the hanger 1 according to the present invention as a hanger for clothes S such as T-shirt and polo shirt and for other goods and by making display in such a manner that the main surface or section of the clothes or other goods is located at the front side, the main surface or section of the good can be made prominent so that customer's attention can be attracted to the goods S. As a result, the goods S can be effectively backed up thereby accomplishing an effect of sales promotion while exhibiting the inherent function of the hanger.

Accordingly, this hanger 1 can effectively solve such problems encountered in conventional hangers that the whole parts of goods which have been wrapped cannot be seen; it is difficult to restore the goods to its original state when the goods are developed upon taking it out from a wrapped package in order to see the whole parts of the goods; there is the fear of a underwear or the like becoming dirty when the underwear or the like is developed and folded. Additionally, this hanger 1 can solve such problems that space-utilizing efficiency is degraded upon hanging wholly developed goods on a hanger; and an effect of sales promotion is diminished under the fact that the goods cannot be well seen. Furthermore, using the hanger 1 according to the present invention can make the goods S prominent, thereby remarkably improving the effect of soles promotion.

While two embodiments of the hanger 1 of the present invention have been shown and described, it will be understood that the hanger of the present invention may not be limited to the two embodiments. Accordingly, for example, it is sufficient that the upper laterally extending member 5 of the hanger main body 2 is so shaped as to securely support the upper part of the goods, for example, both the left-side and right-side shoulder sections of the T-shirt or the polo shirt. Consequently, the shape of the upper laterally extending member 5 is not limited to the above instance in which the upper laterally extending member 5 is shaped arcuate to protrude upwardly and to extend along the large-diameter circle, and therefore the upper laterally extending member 5 may be shaped straight extending. Furthermore, the upper laterally extending member 5 is not limited to the above instance in which it is shaped rectangular and vertically lengthy in cross-section, and therefore the cross-sectional shape of the upper laterally extending member 5 may be formed into other shapes than the rectangular and vertically lengthy shape.

Besides, it is sufficient that the left-side support member 8 and the right-side support member 9 are so shaped as to support the lower part of the goods, and therefore they are not limited to the above instance in which they are different in length from each other, so that they may be the same in length.

Further, the engagement projections 13 and the engagement projections 16 formed on the left-side support member 8, the right-side support member 9, the left-side auxiliary small support member 14, the right-side auxiliary small support member 15, the left-side support member 18, and the right-side support member 17 and the upper and lower laterally extending members 5, 7 are not limited to the above instances in which the support members are formed semicircular. Accordingly, each of the support members may be formed, for example, into the shape constituted of a plurality of uneven wave structures, or the shape constituted of a plurality of uneven fine trapezoidal structures, on an imaginary plane parallel with the upper and lower laterally extending members 5, 7.

As appreciated from the above, according to the present invention, goods can be displayed upon being directly hanged on the hanger. This can make the goods prominent thereby improving the effect of sales promotion, while the feature of the goods can be confirmed at the first glance. Furthermore, the hanger of the present invention is excellent in space-utilizing efficiency and laborsaving while sufficiently exhibiting the inherent function of the hanger. More specifically, the hanger of the present invention exhibits the following effects:

a) To solve such a conventional problem that the whole body, particularly the main part, of the goods cannot be seen since the goods have been folded;

b) To solve such a conventional problem that it is difficult to restore the goods into its original state after the goods have been developed upon being taken out of a wrapped package to see the whole body, particularly the main parts of the goods;

c) To solve such a conventional problem that folding and developing the goods are troublesome, and there is the fear of the goods becoming dirty when the goods are folded or developed;

d) To solve such a conventional problem that it is difficult to confirm the features (such as materials, colors, design and the like) of the goods since the goods have been wrapped;

e) To make it unnecessary to carry out troublesome operations such as taking out the goods from the wrapped package and wrapping again the goods which have been taken out and developed, since the goods are displayed upon being directly hanged on the hanger. This provides an effect of facilitating display of the goods while achieving laborsaving;

f) To make it possible to confirm the features of the goods at the first glance, since the goods are displayed in such a manner that customers can see the main parts of the goods upon partly developing the goods without completely developing the goods;

g) To make it possible to display the goods by partly developing the goods without completely developing the goods, thereby accomplishing display of the goods without taking a large space thus to improve space-utilizing efficiency;

h) To make it possible that customers can surely confirm the goods themselves by displaying the goods upon directly hanging the goods on the hanger without wrapping the goods, thereby providing effects that confirmation of the goods by the customers can be facilitated;

i) To make it possible to confirm the features of the goods at the first glance and to provide effects of improving space-utilizing efficiency and laborsaving while sufficiently exhibiting the inherent function of the hanger;

j) To make it possible to exhibit goods in such a manner that the main parts of the goods can be easily seen upon being partly developed, by directly hanging the goods without wrapping the goods, thereby providing effects of making the goods prominent and improving sales promotion; and k) To make it possible to appropriately use the hanger for the purpose of displaying a shirt such as a T-shirt or a polo shirt, and to use the hanger similarly for the purpose of displaying other general clothes and other goods, thereby providing very great effects that the hanger can be used widely for various purposes.

What is claimed is:

1. A hanger for clothes, comprising:

a hanger main body having a hook to be hanged, said hanger main body supporting an upper section of said clothes;

a connecting section connected to said hanger main body; and a hanger auxiliary body connected through said connecting section with said hanger main body, said hanger auxiliary body having a support section for supporting a lower part of said clothes;

said hanger main body including an upper laterally extending member, said hook being connected to an upper and laterally central portion of said upper laterally extending member;

said hanger auxiliary body including a lower laterally extending member which is generally parallel with said upper laterally extending member, wherein said support section includes first and second support members for supporting the lower part of the clothes, said first and second support members being connected respectively with opposite ends of the lower laterally extending member so as to form a generally U-shaped bent portion between each of said opposite ends and each of said first and second support members, each of said first and second support members extending generally parallel with said lower laterally extending member.

2. A hanger as claimed in claim 1, wherein said first and second support members are disposed under said lower laterally extending member.

3. A hanger as claimed in claim 1, wherein said first and second support members are disposed above said lower laterally extending member.

4. A hanger as claimed in claim 1, further comprising a plurality of engagement projections located near the U-shaped bent portion and formed on each of said first and second support members and on said lower laterally extending member, said engagement projections being located spaced in a lateral direction, each engagement projection on each of first and second support member projecting toward an inner edge of said lower laterally extending member, each engagement projection on said lower laterally extending member projecting toward an inner edge of each of said first and second support members.

5. A hanger as claimed in claim 4, wherein each engagement projection on each of first and second support member is spaced from the inner edge of said lower laterally extending member, wherein each engagement projection on said lower laterally, extending member is spaced from the inner edge of each of said first and second support members.

6. A hanger as claimed in claim 4, wherein each engagement projection is formed generally semicircular on a plane parallel with said lower laterally extending member.

7. A hanger as claimed in claim 1, wherein said upper laterally extending member of said hanger main body, said connecting section, and said hanger auxiliary body are formed integral to constitute a one-piece structure.

8. A hanger as claimed in claim 7, wherein said one-piece structure is formed of a material having an elasticity.

9. A hanger as claimed in claim 8, wherein said plastic is thermoplastic resin.

10. A hanger as claimed in claim 1, wherein said hanger is for a shirt to be displayed.

11. A hanger for clothes, comprising:

a hanger main body including an upper laterally extending member, and a hook to be hanged, connected to said upper laterally extending member;

a connecting section integral with said upper laterally extending member of said hanger main body; and a hanger auxiliary body integral with said connecting section, said hanger auxiliary body including a lower laterally extending member which is generally parallel with said upper laterally extending member, and first and second support members for supporting a lower part of the clothes, said first and second support members being connected respectively with opposite ends of the lower laterally extending member so as to form a generally U-shaped bent portion between each of said opposite ends and each of said first and second support members, each of said first and second support members extending generally parallel with said lower laterally extending member;

wherein at least said upper laterally extending member of said hanger main body, said connecting section, and said hanger auxiliary body are formed integral to constitute a one-piece structure, and formed of plastic.

* * * * *